United States Patent [19]

Gossett

[11] Patent Number: 4,577,859

[45] Date of Patent: Mar. 25, 1986

[54] IN-PLACE SWIMMING APPARATUS

[76] Inventor: Burnham N. Gossett, 2919 S. Lakeridge Trail, Boulder, Colo. 80302

[21] Appl. No.: 537,524

[22] Filed: Sep. 30, 1983

[51] Int. Cl.[4] ..... A63B 31/00

[52] U.S. Cl. ..... 272/71; 434/254; 182/3; 4/488

[58] Field of Search ..... 272/71, 120, 121, 72, 272/117; 4/488, 496, 494, 506; 182/3; 434/254

[56] References Cited

U.S. PATENT DOCUMENTS

| | | | |
|---|---|---|---|
| 1,796,762 | 3/1931 | Paston | 4/504 |
| 2,434,543 | 1/1948 | Borroughs | 434/254 |
| 2,825,224 | 3/1958 | Lindenauer | 272/79 X |
| 3,363,243 | 1/1968 | Morley | 272/71 X |
| 3,395,407 | 8/1968 | Teschner | 4/494 X |
| 3,445,941 | 5/1969 | Eaves et al. | 272/71 X |
| 3,505,992 | 4/1970 | Jaeger | 128/2 |
| 3,512,416 | 5/1970 | Hohwart | 272/71 X |
| 3,861,675 | 1/1975 | Hopper | 272/71 |
| 3,988,020 | 10/1976 | Carter | 272/71 X |
| 4,001,899 | 1/1977 | Mathis | 4/493 X |
| 4,109,905 | 8/1978 | Meier | 272/71 |
| 4,114,874 | 9/1978 | Mattila | 272/71 |
| 4,218,056 | 8/1980 | Whitling | 272/71 |
| 4,247,096 | 1/1981 | Schmitt | 272/71 |
| 4,248,419 | 2/1981 | Hohwart | 272/71 |
| 4,302,007 | 11/1981 | Oprean et al. | 272/116 |
| 4,524,711 | 6/1985 | Ashrow | 272/71 X |
| 4,527,795 | 7/1985 | Zink | 272/71 |

FOREIGN PATENT DOCUMENTS

| | | | |
|---|---|---|---|
| 2821029 | 12/1978 | Fed. Rep. of Germany | 272/71 |
| 910173 | 3/1982 | U.S.S.R. | 272/71 |

*Primary Examiner*—Richard J. Apley
*Assistant Examiner*—Robert W. Bahr
*Attorney, Agent, or Firm*—O'Rourke & Harris

[57] ABSTRACT

An apparatus is disclosed for enabling in-place swimming. This apparatus includes a tank or pool assembly that is of just sufficient dimensions so as to allow a swimmer to execute normal swimming strokes and a restraining assembly to maintain the swimmer in place within the tank during swimming. The tank assembly is preferably largely enclosed and may have included therewith one or more comfort and/or utility features to enhance swimming. The restraining assembly is preferably configured to allow the swimmer relatively free rolling movement while precluding appreciable forward movement due to swimming strokes executed by the swimmer. The apparatus is useful for diverse purposes including exercise, rehabilitation, teaching, training and relaxing.

18 Claims, 5 Drawing Figures

IN-PLACE SWIMMING APPARATUS

FIELD OF THE INVENTION

This invention relates to swimming apparatus and, more particularly, relates to in-place, or tethered, swimming apparatus.

BACKGROUND OF THE INVENTION

The need and/or desire for exercise has long been recognized, and various apparatus have heretofore been developed in an attempt to satisfy such needs or desires.

One of the better forms of exercise has been found to be swimming, and both commercial and private swimming pools are now commonly found. Such pools, however, are normally fairly large and costly to properly maintain and are not sufficiently private for at least some users. In addition, while small water retaining areas have been developed, such areas are not adequate for swimming or are, at least, not adequate to enable a swimmer to satisfactorily exercise or train.

While some attention has also been given to developing systems that enable a swimmer to swim in place, such systems have either been used in conjunction with existing pools, have not enabled the swimmer to utilize normal swimming strokes, and/or have not been developed with a view toward providing a minimal amount of swimming area, lacked attractiveness, have not been adaptable to use in conjunction with swimmer comfort and/or utility features, have been limited to water jets the swimmer to swim against, and/or have been costly.

In-place swimming apparatus for use in existing pools is shown, for example, in U.S. Pat. Nos. 4,109,905, 4,114,874, 4,218,056, 4,247,096, 4,248,419, while a device for use in a restricted water area is shown in U.S. Pat. No. 4,170,799.

SUMMARY OF THE INVENTION

This invention provides a device for in-place, or tethered, swimming having a minimum water area just sufficient to enable execution of normal swimming strokes by the swimmer and restraining means to maintain the swimmer substantially in place during swimming while allowing the swimmer the relatively free rolling movement required to execute normal swimming strokes.

It is therefore an object of this invention to provide an improved device for in-place, or tethered, swimming.

It is another object of this invention to provide an improved device for in-place swimming having a minimum water area.

It is still another object of this invention to provide an improved device for in-place swimming having restraining means that precludes appreciable forward movement of the swimmer while allowing relatively free rolling movement.

It is another object of this invention to provide an improved device for in-place swimming that is adaptable for utilization with comfort and/or utility features.

It is still another object of this invention to provide an improved device for in-place swimming that is attractive both in appearance and swimming environment.

With these and other objects in view, which will become apparent to one skilled in the art as the description proceeds, this invention resides in the novel construction, combination, and arrangement of parts substantially as hereinafter described and more particularly defined by the appended claims, it being understood that changes in the precise embodiment of the herein disclosed invention are meant to be included as come within the scope of the claims.

BRIEF DESCRIPTION OF THE DRAWINGS

The accompanying drawings illustrate a complete embodiment of the invention according to the best mode so far devised for the practical application of the principles thereof, and in which.

DESCRIPTION OF THE INVENTION

Figure 1:
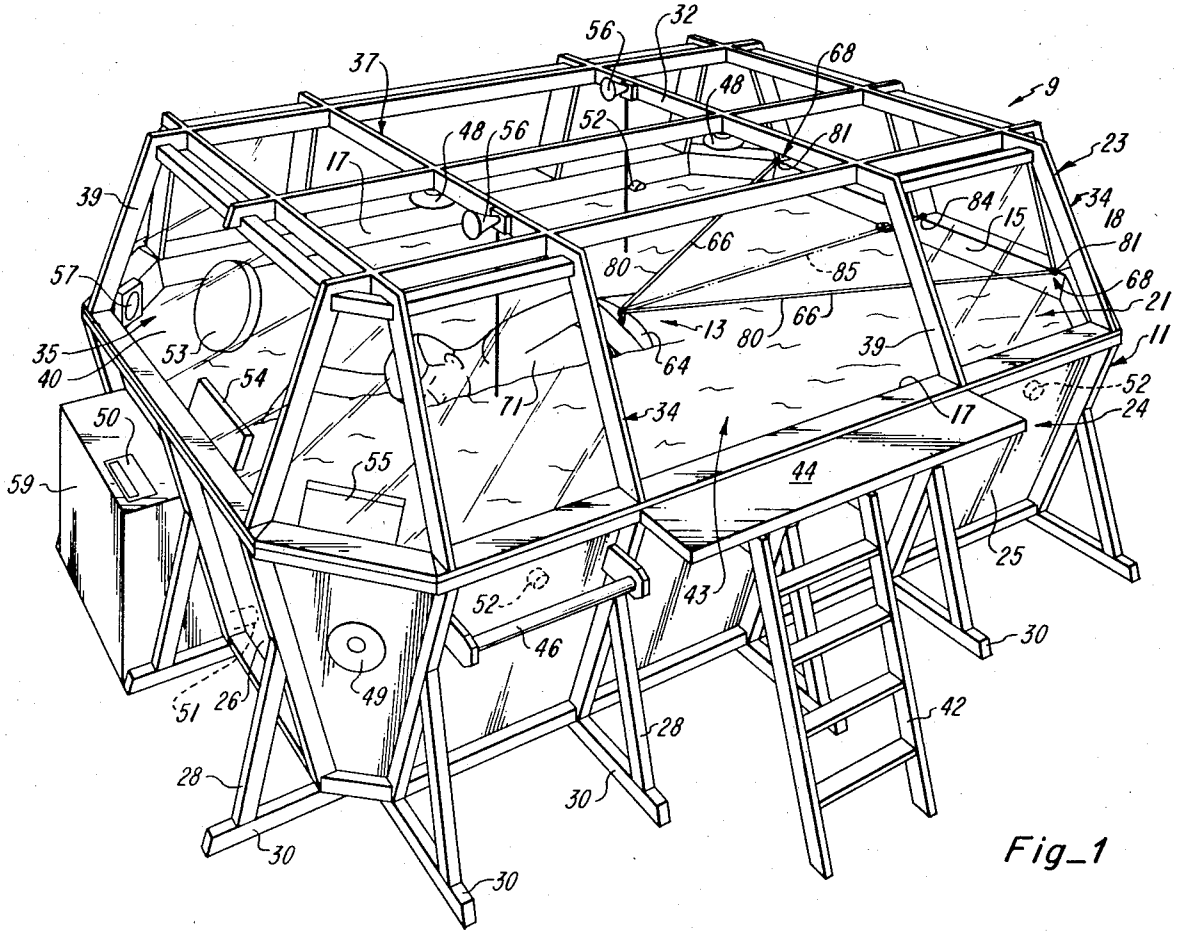
FIG. 1 is a perspective view of the device of this invention illustrating a swimmer having a harness of a restraining assembly positioned about the midsection of the swimmer for in-place swimming within a tank, or pool assembly, with an optional embodiment also being illustrated.

Referring now to FIG. 1, device 9 is shown to include a tank, or pool assembly 11 and a restraining assembly 13. As shown, tank assembly 11 is preferably an open topped tank 15 having side walls 17, end walls 18, and bottom wall 19. As indicated, the walls of tank 15 are preferably integrally formed and are of a water impervious material such as vinyl, ceramic or fiber glass to form a sealed water retaining, or swimming, area 21.

While the walls of tank 15 may be dimensioned in any manner suitable for a particular contemplated use, it has been found preferable to dimension the tank such that it contains water just sufficient to enable the swimmer to execute the normal strokes of swimming, including, but not limited to, for example, the crawl, butterfly, and backstroke. A narrower tank could be utilized, but would limit the swimmer to freestyle (or crawl) and backstroke.

In a working embodiment of this invention, it was found that a properly dimensioned tank allowing a swimmer sufficient area to execute the normal strokes of swimming (provided the swimmer is maintained in position) had the following dimensions: a swimming length (at water level) of about eleven feet or less with a length of about nine feet or less at the bottom of the area; a swimming width (at water level) of about six and one-half feet or less with a width of about four and one-half feet or less at the bottom of the area; a water depth of about three and one-half feet or less; a tank height of about four feet or less; and a total enclosure height of about seven and one-half feet or less. It is to be realized, of course, that the dimensions could be varied as necessary, or desired, to meet a particular application.

An enclosing structure 23 is preferably utilized in conjunction with tank 15 as a part of tank assembly 11. As shown in FIG. 1, the lower portion 24 of structure 23 includes side and end walls 25 and 26 positioned contiguous to and outside walls 17 and 18 of tank 15. Walls 25 and 26 may be vertically positioned or may slant downwardly and inwardly, as shown in FIG. 1, and are preferably of wood but may be formed by any other rigid material, such as plastic or fiber glass, for example. Walls 25 and 26 are also support walls and have legs 28 centrally fastened thereto at one end with legs 28 extending outwardly and downwardly therefrom. The outer ends of legs 28 are fastened to feet 30 which are in ground, or floor, contact. The use of material such as wood or metal allows ready disassembly of the structure for various purposes including moving of the structure to and from restricted access areas.

Enclosing structure 23 also includes an upper section 32 having vertically positioned or upwardly and inwardly slanting side and end walls 34 and 35, as indicated in FIG. 1, which extend from the lower section 24 (section 24 terminates at about the height of tank 15) to top 37 (which top may be open or closed as preferred). Side and end walls 34 and 35 may be of any rigid material, such as wood, plastic, fiber glass and/or plexiglass, and preferably is formed, as shown in FIG. 1, by framing 39 having plexiglass inserts 40 mounted therein (the use of clear inserts allows outside viewing of a swimmer in, or under, water).

A ladder 42 may be provided to facilitate access to swimming area 21 through opening 43 in upper section 32 of enclosing structure 23 (opening 43 may include a door (not shown) if desired to completely enclose the swimming area). To facilitate entry (and egress), a ledge 44 may also be positioned above ladder 42. While not shown, it should be realized that the support structure and/or enclosing structure could be formed in part (or totally) by other structural walls, such as the walls of a building or room, for example.

Comfort and utility features of the structure can include a towel rack 46, lights 48, speaker 49, temperature control and indicator 50, water purifying outlet 51, jet outlets 52, clock 53, digital readout 54, stop watch 55, emergency alarm 56, and a strobe light 57. Any or all of the foregoing can be utilized as considered necessary or desirable. Utilized features can also be varied—towel rack 46 could, for example, be placed inside the enclosure, lights 48 could be inside the enclosure or outside the enclosure with light directed into the enclosure, speaker 49 could be inside or outside the enclosure and could be connected with any sound system or to an audible timing device, and temperature control and indicator 50 could be inside or outside of the enclosure. In addition, and again by way of example, water purifying outlet 51 could be located anywhere within the tank to enable purification, pumping and heating of the water in the tank through a suitable purfication, pumping and heating system 59 located outside of the tank (or fresh water could also be pumped into the tank through outlet 51), jets 52 could be positioned as desired and connected with pumps to form a jacuzzi-like area, clock 53 and digital readout 54 (for speed timing, for example) could be mounted anywhere for easy viewing by a swimmer, stop watch 55 and emergency alarm (button or cord) 56 could be mounted in any manner so as to be readily actutable by the swimmer, and strobe light 57 could be mounted so as to not annoy a swimmer and yet provide a desirable light for timing strokes, for example.

Restraining assembly 13 includes a harness 64 and a resilient connector 66 connecting the harness with a support area 68, which support area can be a wall of tank 15, a wall of enclosing structure 23, and/or a wall of a building structure or the like.

Figure 2:
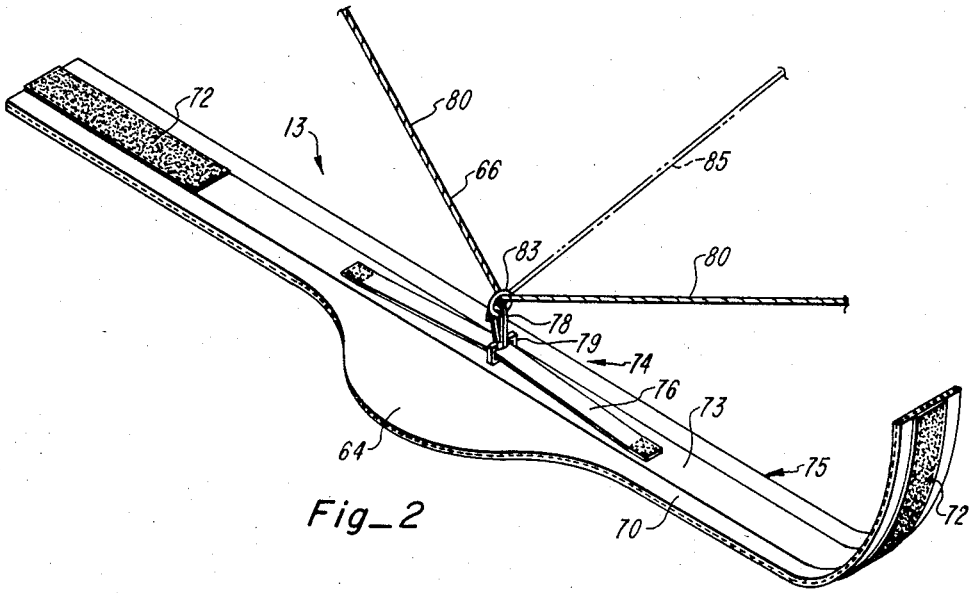
FIG. 2 is a perspective view of a harness utilized as a part of the restraining assembly, as shown in FIG. 1, with the harness shown in an open position.

As best shown in FIG. 2, harness 64 includes a belt 70 adapted to be in contact with and normally circle the waist of a swimmer 71 (as indicated in FIG. 1). Belt 70, is preferably of soft material (such as closed cell foam material covered by nylon cloth, for example), and has a Velcro fastener 72 extending along the outside of belt 70 at one end and along the inside of belt 70 at the other end for releasably holding, or fastening, the belt in position about the waist of a swimmer (other fasteners, such as snap fasteners, for example could also be utilized. A second belt 73 (preferably of nylon, which second belt may be formed, at least in part, by a covering for belt 70) also preferably extends along the outside of inner belt 70. The central area 74 of belt 70 is preferably wider than the outer portion 75 and a strap 76 is attached to outer belt 73 at the central portion 74 of belt 70. A hook 78 (preferably plastic) has a slider 79 thereon which is received around strap 76 to enable hook 78 to freely slide along strap 76 to accomodate the rolling movement of a swimmer normal to execution of normal swimming strokes.

As shown in FIGS. 1 and 2, cord 80 preferably forms resilient connector 66. Shock cord 80 is of resilient material, such as rubber or surgical tubing, for example, and extends from hooks 81 at support area 68 (as shown in FIG. 1). Shock cord 80 also preferably has a ring 83 thereon for enabling hook 78 of belt 70 to be connected to the shock cord (or cords).

The use of belt 70 in connection with shock cord, or cords, 80, enables a swimmer within the enclosure in swim area 21 to execute the normal swimming strokes with the relative freedom of rolling motion necessary, and yet be maintained substantially in place (i.e. with no appreciable forward movement occurring during execution of normal swimming strokes).

The cords may be any length as desired (three feet to eight feet, for example), and may be sized to provide different forces on a swimmer as may be required for different swimmers. In addition, the shock cord may be connected to different support areas 68 (as indicated, for example, by the dotted line connected as shown in FIG. 1 with cord 85 extending rearwardly to hook 84 at the rear center of the back wall.

Figure 3:
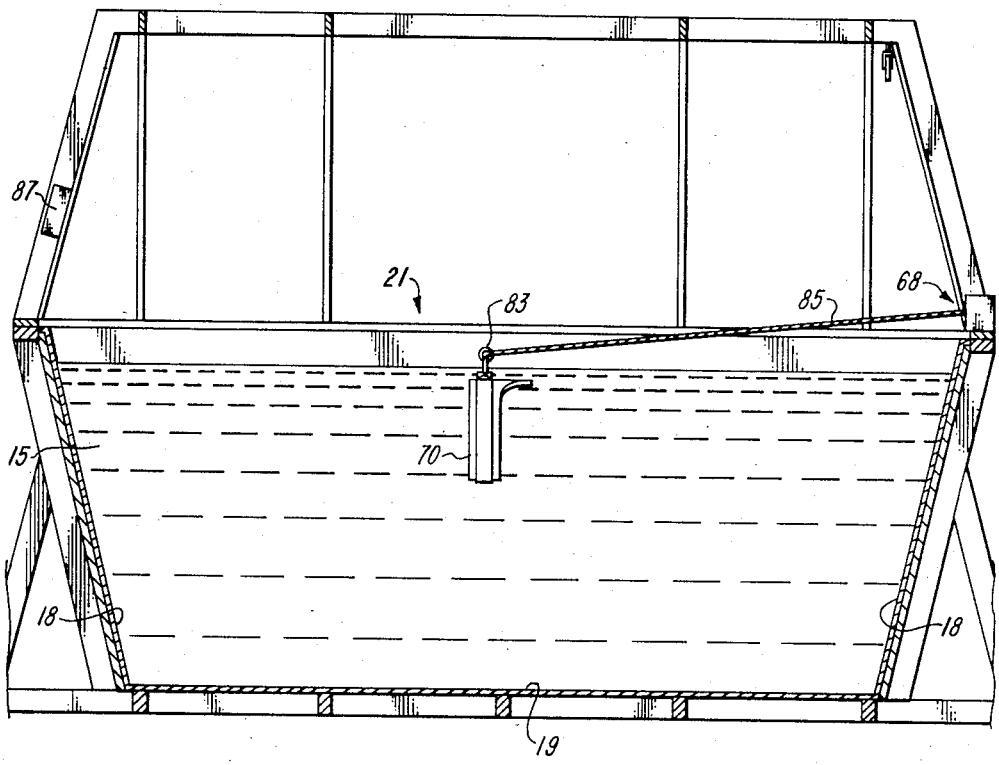
FIG. 3 is a cut-away side view of the tank assembly as shown in FIG. 1 and showing the harness shown in FIG. 2 positioned as if it were about the midsection of the swimmer and illustrating a third embodiment of the restraining assembly used as a part of the device for in-place swimming.

While not specifically indicated in FIG. 3, cord 85 could also extend through pulleys (which serves as support areas 68 at the lower rear and upper rear center portions of the back wall and the upper front center portion) to an electronic load cell digital readout 87. This would, of course, allow a swimmer direct readout.

Figure 4:
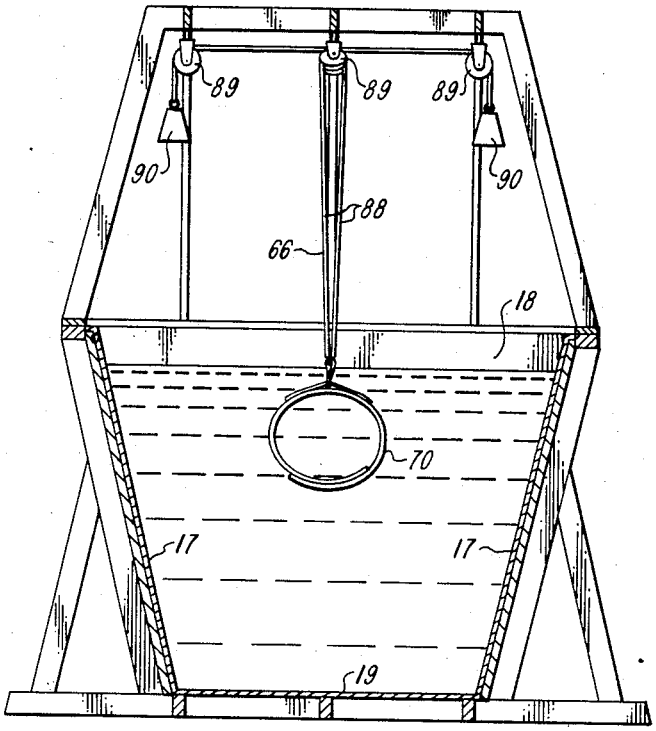
FIG. 4 is a cut-away end prospective view of the tank assembly as shown in FIG. 1 and illustrating a fourth embodiment of a restraining assembly which may be used as a part of the device for in-place swimming.
Figure 5:
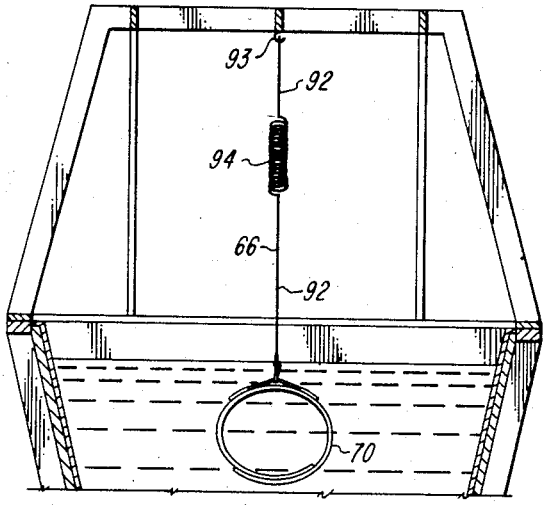
FIG. 5 is a view similar to that of FIG. 4 but illustrating the use of a spring system of force measurement as an example of measuring devices that can be utilized.

As shown in FIG. 4, resilient connector 66 could also be configured by means of cords 88 extending through pulleys 89 at the lower rear side portions of the back wall to weights 90. The value of the weights are chosen as needed for a particular swimmer. As shown in FIG. 5, resilient connector 66 could also be configured by means of cord 92 extending to hook 93 at the lower central portion of the back wall through a spring system of force measurement 94. In each case, the desired force is established to act against the forces exerted by the swimmer when executing the normal swimming strokes.

In operation, a user selects the adjustable conditions (such as lighting, sound, and temperature conditions as desired and available). After entering the swimming area, the swimmer normally places the harness about his waist and fastens it firmly, or snuggly, using the velcro fasteners. The swimmer then selects the shock cord (or weight depending upon the type of apparatus) to be utilized to enable swimming in place. Normally, the swimmer will select shock cords attached to a support area at the rear of the pool.

In the normal swimming position, as shown in FIG. 1, the buckle will be above the swimmer (i.e., at the back of the swimmer when the swimmer's back is at the top of the water). The swimmer then proceeds to swim in a normal manner executing the normal swimming strokes. If the swimmer finds that the restraining assembly is not maintaining the swimmer in place or the swimmer is reaching the end of the pool, then a shorter or stiffer cord (or a different force system if available) may be selected. In addition, other support areas may be selected (such as shown by the drawings, for example). After the proper cord and support area (or alternate force system, if available) have been selected, the restraining assembly will hold the swimmer in place (i.e. will not allow the swimmer to move appreciably in a forward direction) and yet will allow the swimmer to roll from side to side as necessary to execute the normal swimming strokes. When finished, the swimmer releases the harness from about his waist and then can leave the swim area.

The device of this invention has been known to be useful for exercise, and also has been found effective in training of a swimmer, rehabilitation of injured persons, and teaching of swimming, and is particularly adaptable to blind swimmers.

As can be appreciated from the foregoing, this invention provides an in place swimming device that is efficient yet practical for performing its intended function.

What is claimed is:

1. A device for in-place swimming, said device comprising:

structural tank defining means having a first portion with dimensions to contain a predetermined quantity of liquid just sufficient to enable an in-place swimmer to execute strokes common to normal swimming without appreciable extra liquid quantities being contained by said first portion, and a second portion for providing at least support means contiguous to said first portion; and restraint means having a first portion including belt means adapted to be releasably secured about the body of a swimmer in said liquid, and slidable fastening means having a first unit extending along said belt means a distance sufficient to substantially span the width of the body of a swimmer wearing said belt means with said first unit being connected with said first portion of said restraint means adjacent to the opposite sides of the width of the body of a swimmer wearing said belt means, and a second unit cooperable with said first unit to allow sliding movement of said second unit substantially entirely along said first unit between said connections of said first unit to said first portion of said restraint means so that said second unit can slide along substantially the entire width of the body of a swimmer, and said restraint means also having a second portion physically connected with said support means and said second unit of said slidable fastening means, said second portion of said restraint means including force means for at least exerting a force on a swimmer opposing forward movement of said swimmer from a predetermined position in said liquid due to the forwardly force exerted by said swimmer when executing said strokes common to normal swimming so that said swimmer, when secured to said restraint means, is able to swim in a normal manner and yet remain substantially in place in said liquid to thereby avoid contact with said structural means while swimming in said normal manner.

2. The device of claim 1 wherein said first portion of said structural means includes open tank means, and wherein said structural means also includes enclosure means for at least partially enclosing said tank means.

3. The device of claim 2 wherein said enclosure means includes means for substantially entirely enclosing said tank means.

4. The device of claim 2 wherein said enclosure means includes one of wood and metal frame means.

5. The device of claim 1 wherein said first portion of said structural means provides a liquid container such that said contained liquid presents a swim area that is not over about eleven feet in length, about six and one-half feet in width, and about four feet in depth at the surface of said swim area.

6. The device of claim 5 wherein said first portion of said structural means is tapered such that a lesser amount of liquid is present at the bottom of said swim area relative to said surface of said swim area.

7. The device of claim 1 wherein said first portion of said restraint means is a belt that is adapted to encircle the waist of a swimmer, said belt having slidable fastening means thereon.

8. The device of claim 7 wherein said belt has a strap connected with the outer side, and said slidable fastening means slidably connected with said strap.

9. The device of claim 8 wherein said belt is foam material covered with nylon.

10. The device of claim 7 wherein said second portion of said restraint means includes resilient means having one portion connected with said slidable fastening means so that said swimmer can roll in a nearly normal manner during swimming.

11. The device of claim 10 wherein said resilient means includes a length of stretchable material.

12. The device of claim 7 wherein said force means of said second portion of said restraint means includes weight means acting against said force exerted by said swimmer.

13. The device of claim 7 wherein said force means includes electronic load cell digital readout means.

14. The device of claim 7 wherein said force means of said second portion of said restraint means includes a spring system.

15. A device for in-place swimming, said device comprising:

tank means having a first portion providing a container for containing a predetermined amount of water, said container being upwardly and outwardly tapered to receive a quantity of water such that the surface area of said water does not exceed a length of more than about eleven feet and a width of more than about six and on-half feet with a depth of said water being not more than about four feet and with the water-contacting area of the bottom of said container having a length not exceeding about nine feet and a width not exceeding about four and one-half feet;

enclosure means for at least partially enclosing said tank means, said enclosure means extending about said tank means a distance sufficient to enable a swimmer to stand when in said tank means; and restraint means including belt means adapted to be worn by a swimmer, with said restraint means also including sildable fastening means having a first unit extending along said belt means a distance sufficient to substantially span the width of the body of a swimmer wearing said belt means with said first unit being connected with said belt means adjacent to the opposite sides of the width of the body of a swimmer wearing said belt means, and a second unit cooperable with said first unit to allow sliding movement of said second unit substantially entirely along said first unit between said connections of said first unit to said belt means so that said second unit can slide along substantially the entire width of the body of a swimmer, and said restraint means also including force exerting means physically connected with said second unit of said slidable fastening means and one of said tank means and said enclosure means to provide a force opposing forward movement of a swimmer wearing said restraint means from a predetermined position in said water so that said swimmer swims substantially in place while executing normal swimming strokes to thereby avoid contact with said tank means and said enclosure means while executing said normal swimming strokes.

16. The device of claim 15 wherein said device includes means for timing said swimmer in said water.

17. The device of claim 15 wherein said device includes swimmer comfort and safety means.

18. The device of claim 15 wherein said device includes emergency alarm means actuatable by a swimmer in said tank means.

* * * * *

UNITED STATES PATENT AND TRADEMARK OFFICE

CERTIFICATE OF CORRECTION

PATENT NO. : 4,577,859

DATED : March 25, 1986

INVENTOR(S) : Burnham N. Gossett

It is certified that error appears in the above-identified patent and that said Letters Patent is hereby corrected as shown below:

Column 6, line 63, "on-half" should read -- one-half --.

Signed and Sealed this

*Eighth* Day of *July 1986*

[SEAL]

*Attest:*

DONALD J. QUIGG

*Attesting Officer*

*Commissioner of Patents and Trademarks*